US005295603A

United States Patent [19]

Schormair et al.

[11] Patent Number: 5,295,603

[45] Date of Patent: Mar. 22, 1994

[54] PRESSURE LID CONTAINER

[75] Inventors: Eckart Schormair, Otersen; Bernard De Turckheim, Bremen; Rolf Hornig, Kirchlinteln-Luttum, all of Fed. Rep. of Germany

[73] Assignee: Effem GmbH, Verden/Aller, Fed. Rep. of Germany

[21] Appl. No.: 917,067

[22] PCT Filed: Nov. 15, 1991

[86] PCT No.: PCT/DE91/00911

§ 371 Date: Sep. 28, 1992

§ 102(e) Date: Sep. 28, 1992

[87] PCT Pub. No.: WO92/09495

PCT Pub. Date: Jun. 11, 1992

Related U.S. Application Data

[63] Continuation-in-part of Ser. No. 856,057, May 8, 1992.

[30] Foreign Application Priority Data

Dec. 1, 1990 [DE] Fed. Rep. of Germany ..... 4038870

[51] Int. Cl.[5] ..... B65D 39/00

[52] U.S. Cl. ..... 220/307; 220/284; 220/285

[58] Field of Search ..... 220/307, 284, 285, 308, 220/354

[56] References Cited

U.S. PATENT DOCUMENTS

| | | | |
|---|---|---|---|
| 2,107,437 | 2/1938 | Forsyth | 220/307 |
| 3,912,110 | 10/1975 | Hammes | 220/307 X |
| 3,979,015 | 9/1976 | Arfert . | |

FOREIGN PATENT DOCUMENTS

| | | | |
|---|---|---|---|
| 146363 | 7/1936 | Australia | 220/307 |
| 567215 | 12/1932 | Fed. Rep. of Germany | 220/307 |
| 731600 | 2/1943 | Fed. Rep. of Germany | 220/307 |
| 45450 | 9/1935 | France | 220/307 |
| 607701 | 10/1978 | Switzerland . | |
| 2033880 | 5/1980 | United Kingdom . | |

*Primary Examiner*—Allan N. Shoap
*Assistant Examiner*—Paul A. Schwarz
*Attorney, Agent, or Firm*—Curtis, Morris & Safford

[57] ABSTRACT

Pressure lid can or container with an at least one-part body member and a lid member, which together with the closure-side end of the body member forms a tight closure, in which a lever gap is left free between the body member and the lid member for the engagement of a lever enabling the lid member to be levered up and in which the lid member has an all-round, resilient engagement lip, which engages from the inside under pretension in a closure crease of the body member adapted to the engagement lip shape (according to patent application P 40 29 146.4), in which instead of the engagement lip of the lid member engaging in a separately produced closure crease, it resiliently engages below an inwardly rolled, upper circumferential edge bead of the body element.

3 Claims, 3 Drawing Sheets

PRESSURE LID CONTAINER

This application is a continuation-in-part of U.S. patent application Ser. No. 856,057, filed May 8, 1992.

FIELD OF THE INVENTION

The invention relates to a pressure lid can or container with an at least one-part body member and a lid member, which together with the closure-side end of the body member forms a tight closure, in which a lever gap is left free between the body member and the lid member for the engagement of a lever enabling the lid member to be levered up and in which the lid member has an all-round, resilient engagement lip, which engages from the inside under pretension in a closure crease of the body member adapted to the engagement lip shape. Such a pressure lid can or container is the subject of co-pending U.S. patent application Ser. No. 865,057, the disclosure of which is incorporated herein by reference.

SUMMARY AND OBJECTS OF THE INVENTION

The the foregoing pressure lid container makes it possible in an advantageous manner to resiliently engage the lid member in the closure crease of the body member, so that the lid member can be kept under pretension in the closure crease plane, in that the engagement lip presses with spring tension into the closure crease. The essential advantage of such a closure is that such a pressure lid container can be opened easily and in non-destructive manner without using any special tool, in that by engaging a lever in the lever gap, the engagement lip is drawn radially inwards, whereas the body element is pressed outwards, so that the engagement lip is disengaged from the closure crease in the vicinity of the lever. An extremely good seal can be obtained through the engagement of the closure with high spring tension. Another important advantage is that the pressure lid container can be reused, so that it can be employed in the form of a multiuse pack.

The problem to which the present invention is directed is to the further development of the foregoing pressure lid container with a lid closure which can be levered up, so that while retaining all the aforementioned advantages, in particular, the production of the body member is simplified and the filling and closing of the container are optimized.

According to the invention this problem is solved in that, instead of the engagement lip of the cover member engaging in a separately produced closure crease, it resiliently engages below an inwardly rolled, upper circumferential edge bead of the body element.

This measure makes it possible to use the upper circumferential edge bead which is normally present on all container body members (provided that the bead is inwardly rolled) directly as the closure element for the novel pressure lid container according to U.S. patent application Ser. No. 865,057 without having to make a separate closure crease for this purpose. In addition, with such a construction, the volume of the container body member can be utilized in an optimum manner for filling purposes, because the engagement lip of the lid member engages directly on the upper circumferential edge of the body member. As is described in greater detail hereinafter, it is also possible to further optimize the container closure process.

According to a special embodiment of the invention, below the circumferential edge bead and at a distance essentially corresponding to the external diameter of the engagement lip, is provided an inwardly impressed body crease. This additional body crease makes it possible to support the lid member on the side facing the lever application point during the opening of the lid and simultaneously prevents an accidentally excessively deep pressing of the lid into the body member on closing.

Alternatively to this, below the circumferential edge bead at a distance essentially corresponding to the external diameter of the engagement lip, the body member diameter is so reduced so that there is a step offset into the interior of the body member. This embodiment has the equivalent effect to the aforementioned additional, lower body crease and is preferred if the body member is a more flat or shallow container, e.g. in the form of a dish or tray.

Preferably a sealant is provided below the circumferential edge bead in the area in which the engagement lip resiliently engages below the same. The sealant makes it possible to hermetically seal the pressure lid container and with respect to the behaviour of the closed container during sterilization, the same advantages are obtained as described in the the parent to this patent application.

It is particularly preferred if the sealant has a bactericidal finish, e.g. as a result of the addition of ascorbic acid, so as to prevent bacteria from penetrating the sealant.

According to another embodiment of the invention the lid member is made from plastic. Unlike in the case where the lid member is made from very fine metal sheeting, here the engagement lip would be rolled from solid material and the material thickness could be greater.

When the lid member is made from plastic, preferably means for reducing an overpressure are incorporated into the container, which conveniently comprises an integrated, semipermeable overpressure or pressure relief valve.

According to another embodiment of the invention, the circumferential edge bead is so constructed that it cross-sectionally tapers towards its upper end by bevelling its inner circumferential surface. This is intended to facilitate the pressing in of the lid member during the first or repeated closing of the body member, because as a result of the sliding down of the engagement lip on the bevel of the circumferential edge bead, the latter can be pressed outwards without any significant use of force.

BRIEF DESCRIPTION OF THE DRAWINGS

The invention is described in greater detail hereinafter relative to non-limitative embodiments and the attached drawings, wherein.

DETAILED DESCRIPTION

Figure 1:
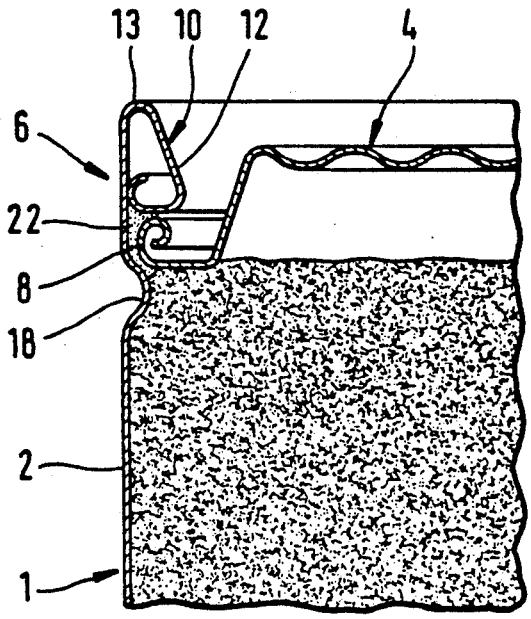
FIG. 1 depicts a partial cross-section through the closure area of a first embodiment of the inventive pressure lid container in the closed state.

The pressure lid container 1 comprises a cylindrical body member 2, whose upper end constitutes the body element 6. The pressure lid container 1 is closed in this part with a lid member 4, whose engagement lip 8 resiliently engages in the gap between the inwardly rolled, upper circumferential edge bead 10 of the body element 6 and the inwardly impressed body crease 18. The distance between the body crease 18 and the lower end of the circumferential edge bead 10 essentially corresponds to the external diameter of the engagement lip 8, so that the latter engages directly below said bead.

Figure 2:
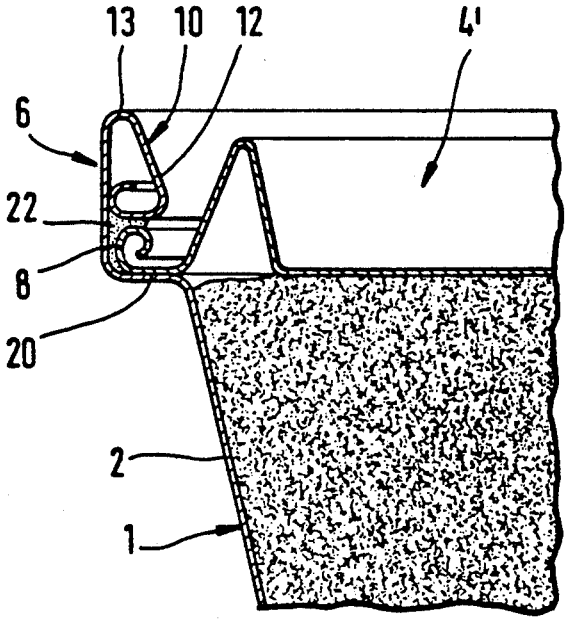
FIG. 2 depicts a partial cross-section through the closure area of a second embodiment of the inventive pressure lid container in the closed state.

Alternatively thereto and as shown in FIG. 2, the engagement lip 8 of a lid member 4' can be supported towards the bottom on a step 20, which is formed in that the diameter of the body member 2 is reduced at a distance which also substantially corresponds to the external diameter of the engagement lip. This embodiment is particularly preferred if the container is, e.g., shaped as a relatively shallow dish or tray.

For a hermetic sealing of the lid closure in both cases a sealant 22 is provided between the engagement lip 8 and the gap between the circumferential edge bead 10 and the body crease 18 or the step 20. The cover member 4 or 4' and the body member 2 are preferably joined together with the sealant still liquid. A bactericidal finish of the sealant, e.g. with ascorbic acid, can effectively prevent the seal from being penetrated by bacteria.

Independently of whether or not a sealant 22 is used, in all cases the lid member 4 or 4' can be reused for reclosing the pressure lid container. Thus, the inventive pressure lid container (like that of the parent to this patent application) can be used on a number of occasions, optionally in the form of a multi-use pack.

Figure 3:
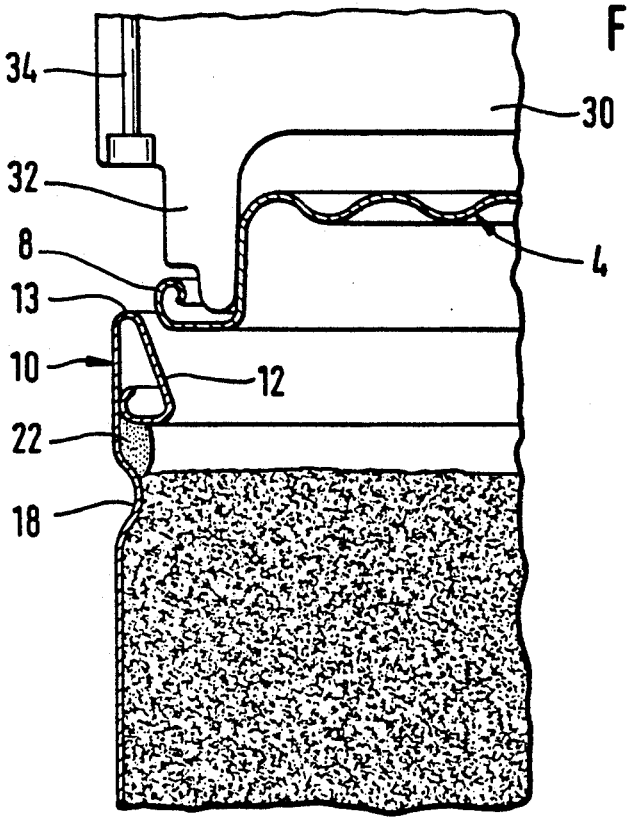
FIG. 3 depicts a partial cross-section through the closure area of the first embodiment of the inventive pressure lid container during the closing process.
Figure 4:
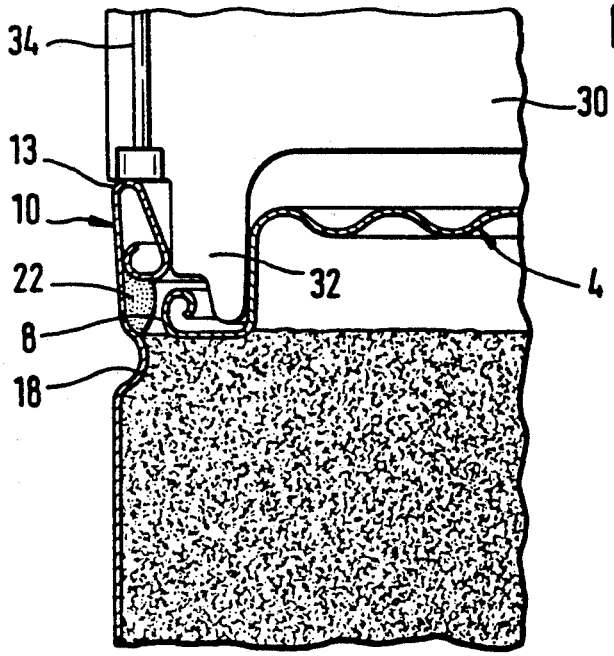
FIG. 4 depicts a similar view to FIG. 3 showing a later stage during the closure process.

FIGS. 3 and 4 show the procedure for the first automated closing of the inventive pressure lid container after filling. For this purpose the lid member 4 is inserted, initially under pretension, in the closing head 30 of a closing apparatus. In this state the lid diameter is reduced to such an extent that the engagement lip 8 is located on the entire circumferential edge of the lid member in the position shown in FIG. 3 at a limited distance from the upper end 13 of the circumferential edge bead 10. If the closing head 30 moves further down, the engagement lip and the bevelled, inner circumferential surface 12 of the circumferential edge bead 10 strike one another and any excess filling material is then squeezed out.

If the closing head moves still further down, then the circumferential edge bead 10 is forced outwards over its entire circumference about an axis roughly located in the vicinity of the body crease 18, firstly by the engagement lip 8 and subsequently by the corresponding ring extension 32 of the closing head 30 (cf. FIG. 4). When the engagement lip 8 is level with the gap between the circumferential edge bead 10 and the body crease 18 and, into which the sealant 22 has preferably been introduced in the still liquid state, by operating the ejector 34 (which is supported on the upper end 13 of the circumferential edge bead 10) the closing head 30 moves upwards again and the lid member 4 now resiliently engages below the circumferential edge bead 10 in the manner shown in FIG. 1 and, together with the plasticizing sealant 22, forms a hermetic closure for the pressure lid container.

If the inventive pressure lid is pressed in as a container closure by the container filler during the initial filling operation, in the case of a corresponding lid shaping, the dome space which is free from product can be filled with steam by a lance at the instant of pressing in. The condensation of the steam leads to a vacuum in the container, which draws the lid onto the area of the body element 6 covered by the sealant 22.

Figure 5:
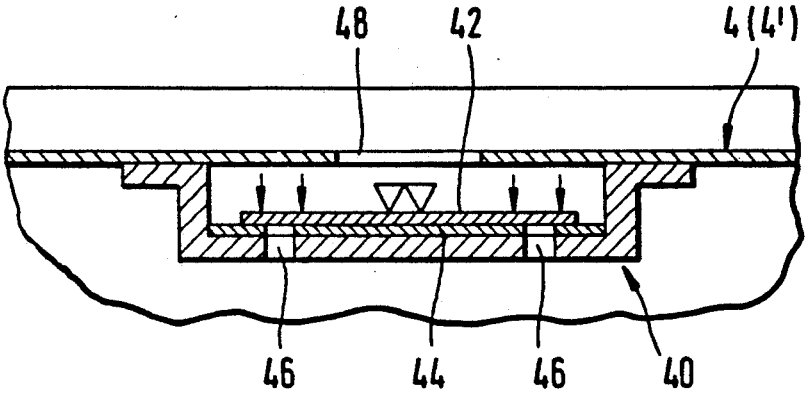
FIG. 5 depicts a diagrammatic cross-sectional view through an inventive lid member with an incorporated pressure relief valve in the sealed state.
Figure 6:
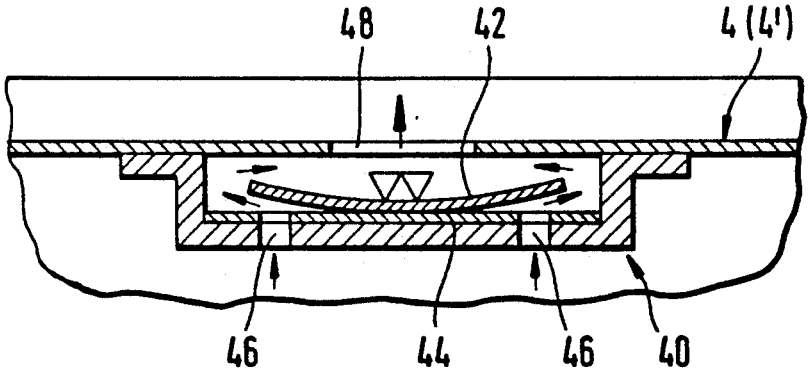
FIG. 6 depicts a view as in FIG. 5 showing the corresponding pressure relief valve during the escape of expanded gas from the interior of the container.

When using a lid member 4 or 4', suitable pressure reduction means can be incorporated for reducing an overpressure resulting from the air or gas in the container during sterilization. FIGS. 5 and 6 show such an integrated, semipermeable pressure relief valve (a so-called coffee valve) and its function. When the container is closed without overpressure the diaphragm 42 of the pressure relief valve 40 sealingly engages on the sealing surface 44 and covers the openings 46 towards the container interior (FIG. 5). If an overpressure is formed in the container (e.g. during sterilization), in the vicinity of the openings 46, the diaphragm 42 is raised from the sealing surface 44, so that the expanding gas can flow from the container interior out of the openings 46 and 48. Consequently, the overpressure which has formed in the container interior is reduced.

Although the invention has been described in accordance with preferred embodiments, it will be seen by those skilled in the art that many modifications can be made within the spirit and scope of the present invention, and there is no intention to limit the scope of the present invention to any of these embodiments. Rather, the scope of the present invention is to be measured by the appended claims.

We claim:

1. A pressure lid container comprising a body member and a lid member, said lid member having an all-around, resilient engagement lip for engagement with said body member from the inside under pretension and being insertable into a closure-side end of said body member to form a tight closure therewith, said engagement lip having an axial thickness, said lid member including a portion spaced radially inwardly from said closure-side end of said body member to define a lever gap between said body member and said lid member for the engagement of a lever to permit said lid member to be levered up, said closure-side end of said body member including an inwardly rolled, upper circumferential edge bead and an inwardly impressed crease, said upper circumferential edge bead having an exposed end so that said lever may be levered against it as a fulcrum, said inwardly impressed crease being below said inwardly rolled, upper circumferential edge bead at a distance essentially corresponding to the axial thickness of said engagement lip so that, when said lid member is inserted, said engagement lip is engaged between said inwardly impressed crease and said inwardly rolled, upper circumferential edge bead.

2. A pressure lid container according to claim 1, wherein a sealant is provided below the circumferential edge bead in the area with which the engagement lip engages.

3. A pressure lid container comprising a body member and a lid member, said lid member having an all-around, resilient engagement lip for engagement with said body member from the inside under pretension and being insertable into a closure-side end of said body member to form a tight closure therewith, said engagement lip having an axial thickness, said lid member including a portion spaced radially inwardly from said closure-side end of said body member to define a lever gap between said body member and said lid member for the engagement of a lever to permit said lid member to be levered up, said closure-side end of said body member including an inwardly rolled, upper circumferential edge bead and an inwardly directed step, said upper circumferential edge bead having an exposed end so that said lever may be levered against it as a fulcrum, said inwardly directed step being below said inwardly rolled, upper circumferential edge bead at a distance essentially corresponding to the axial thickness of said engagement lip so that, when said lid member is inserted, said engagement lip is engaged between said inwardly directed step and said inwardly rolled, upper circumferential edge bead.

* * * * *